US005263884A

United States Patent [19]

Oishi

[11] Patent Number: 5,263,884

[45] Date of Patent: Nov. 23, 1993

[54] LATCH FOR A COWLING OF AN OUTBOARD ENGINE

[75] Inventor: Hiroshi Oishi, Hamamatsu, Japan

[73] Assignee: Yamaha Motor Co. Ltd., Japan

[21] Appl. No.: 948,573

[22] Filed: Sep. 23, 1992

[30] Foreign Application Priority Data

Sep. 27, 1991 [JP] Japan ..... 3-276515

[51] Int. Cl.[5] ..... B63H 21/26

[52] U.S. Cl. ..... 440/77; 123/195 P

[58] Field of Search ..... 440/76, 77; 74/480 B, 74/487, 500.5, 500.5 R, 502.6, 502.4, 489; 123/195 P

[56] References Cited

U.S. PATENT DOCUMENTS 4,938,733 7/1990 Patterson ..... 74/489

4,971,587 11/1990 Uchida et al. ..... 440/77

FOREIGN PATENT DOCUMENTS 2147399 12/1990 Japan .

3112798 5/1991 Japan .

*Primary Examiner*—Jesûs D. Sotelo

*Attorney, Agent, or Firm*—Bacon & Thomas

[57] ABSTRACT

A latch assembly for releasably securing a cowling of a marine propulsion engine comprising a front latch mechanism which is interconnected with at least one rear latch mechanism by a wire cable having a slack adjuster along its length. In a preferred embodiment, a single front latch mechanism and two rear latch mechanisms are linked by the wire cable to an operating lever so that movement of the operating lever causes all of the latches to be disengaged simultaneously. The slack adjuster is simple and easily adjustable to remove slack along the entire cable.

10 Claims, 5 Drawing Sheets

LATCH FOR A COWLING OF AN OUTBOARD ENGINE

BACKGROUND OF THE INVENTION

I. Field of the Invention

The present invention pertains to a cowling for a marine propulsion engine and, more particularly, a latch assembly for releasably securing an upper cowling member to a lower cowling member.

II. Discussion of the Prior Art

It is widely known in the art of engine driven watercrafts to provide a cowling to cover the propulsion engine. In general, such cowlings consist of two parts, an upper cowling, which extends over the engine, and a lower cowling. It is necessary that the upper cowling be removable from the lower cowling in order to perform engine maintenance. This requires that there be a latch mechanism to secure the upper cowling to and release it from the lower cowling.

Known prior art latch mechanisms for use in securing an upper cowling to a lower cowling include both fore and aft latching units that must be separately released. In order to disengage such aft latching units, a person must lean from inside the watercraft over the water to reach and disengage the rear latch unit. This creates a potentially dangerous situation. It has also heretobefore been proposed to link the fore and aft latch units of a cowling assembly with a wire cable, such that the rear latch unit can be disengaged from adjacent the rear of the watercraft. An example of such a prior art arrangement is represented by Japanese Patent Application Publication HEL 2-141390. In such prior art wire cable linkage arrangements, the wire cable linking the fore and aft latch units tends to develop slack over time such that operation of the latch mechanism from adjacent the rear of the watercraft fails to release the aft latch unit.

Therefore, there exists a need in the art for a latch assembly to releasably secure an upper cowling member to a lower cowling member for a marine propulsion engine, which can reliably release both fore and aft latch units from adjacent the rear of the watercraft even if slack develops in the wire cable linking the fore and aft latch units.

SUMMARY OF THE INVENTION

It is an object of the present invention to provide a cowling structure for a marine propulsion engine that incorporates a latch assembly including fore and aft latch units which are interconnected by a wire cable to a single latch release readily accessible from adjacent the rear of the watercraft, wherein activation of the latch release will reliably release both the fore and aft latch units even if slack develops in the wire cable.

This and other objects of the present invention are accomplished by providing a cowling assembly for a marine propulsion engine comprising an upper cowling which is attached via a latch mechanism to a lower cowling. The latch mechanism includes fore and aft latching units, both of which are linked to a clamping lever located adjacent the front latching unit. The front and rear latching units are connected to the clamping lever by means of a wire cable and a tension adjustment arrangement is provided to accommodate slack developed in the wire cable during use.

DETAILED DESCRIPTION OF THE PREFERRED EMBODIMENTS

Figure 1:
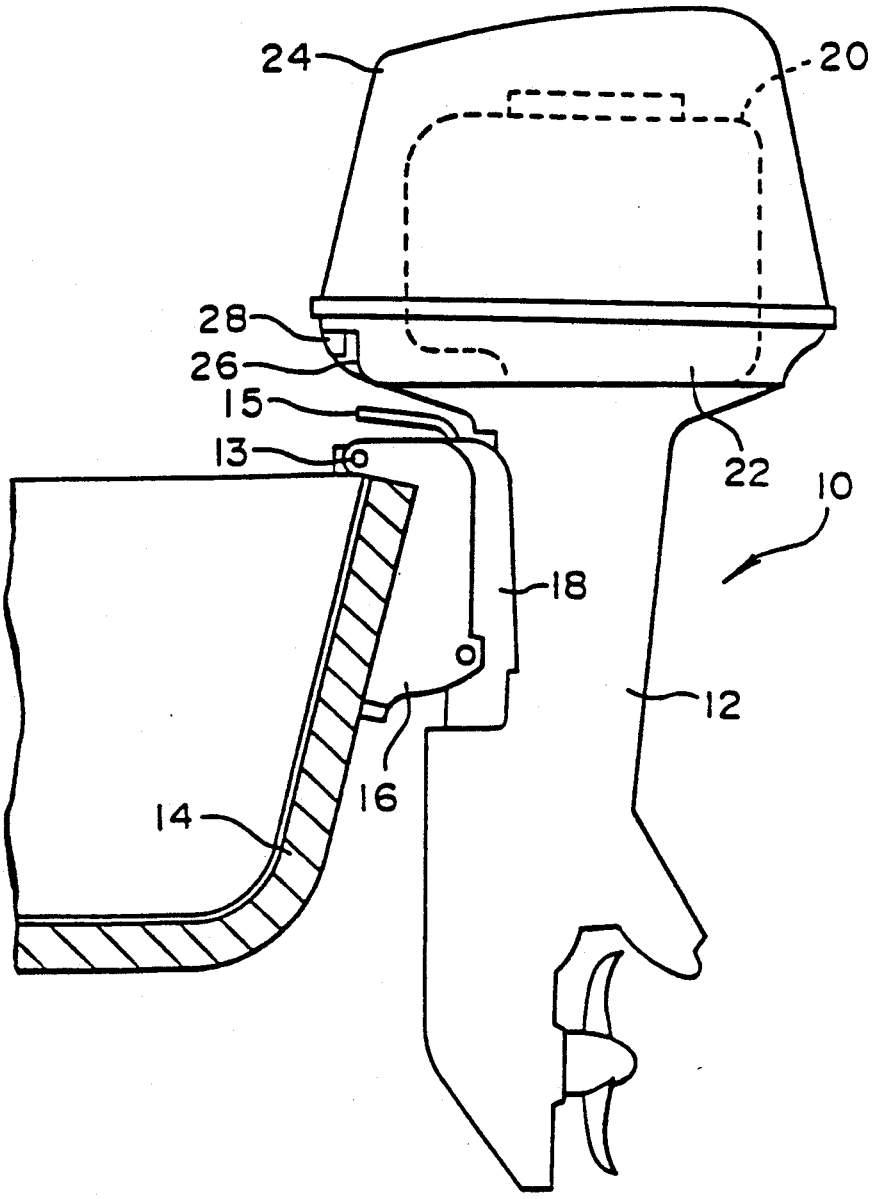
FIG. 1 shows a schematic side view of an outboard engine having a cowling incorporating the latch assembly of the present invention.

With initial reference to FIG. 1, an outboard engine 10 including a propulsion unit 12 pivotally attached by means of a substantially horizontally extending tilt pin 13 to a transom 14 of a watercraft so as to be pivotal between raised and lowered positions is shown. Propulsion unit 12 can also be steered by means of a steering bracket 15. Tilt pin 13 is formed as part of a clamp bracket 16 and steering bracket 15 is formed part of a swivel bracket 18 to pivotally and steerably attach propulsion unit 12 to transom 14 in a manner known in the art. An engine 20 is positioned above propulsion unit 12 and is covered by an upper cowling 24 which is attached to a lower cowling 22 via a seal (not shown). Lower cowling 22 is provided with a recessed area 26 within which is mounted a clamping lever 28. Clamping lever 28 functions to operate the latching mechanism of the present invention as will be described in detail below. Clamping lever 28 is designed so that the shape of its exterior surface conforms to the exterior surface shape of lower cowling 22.

Figure 2:
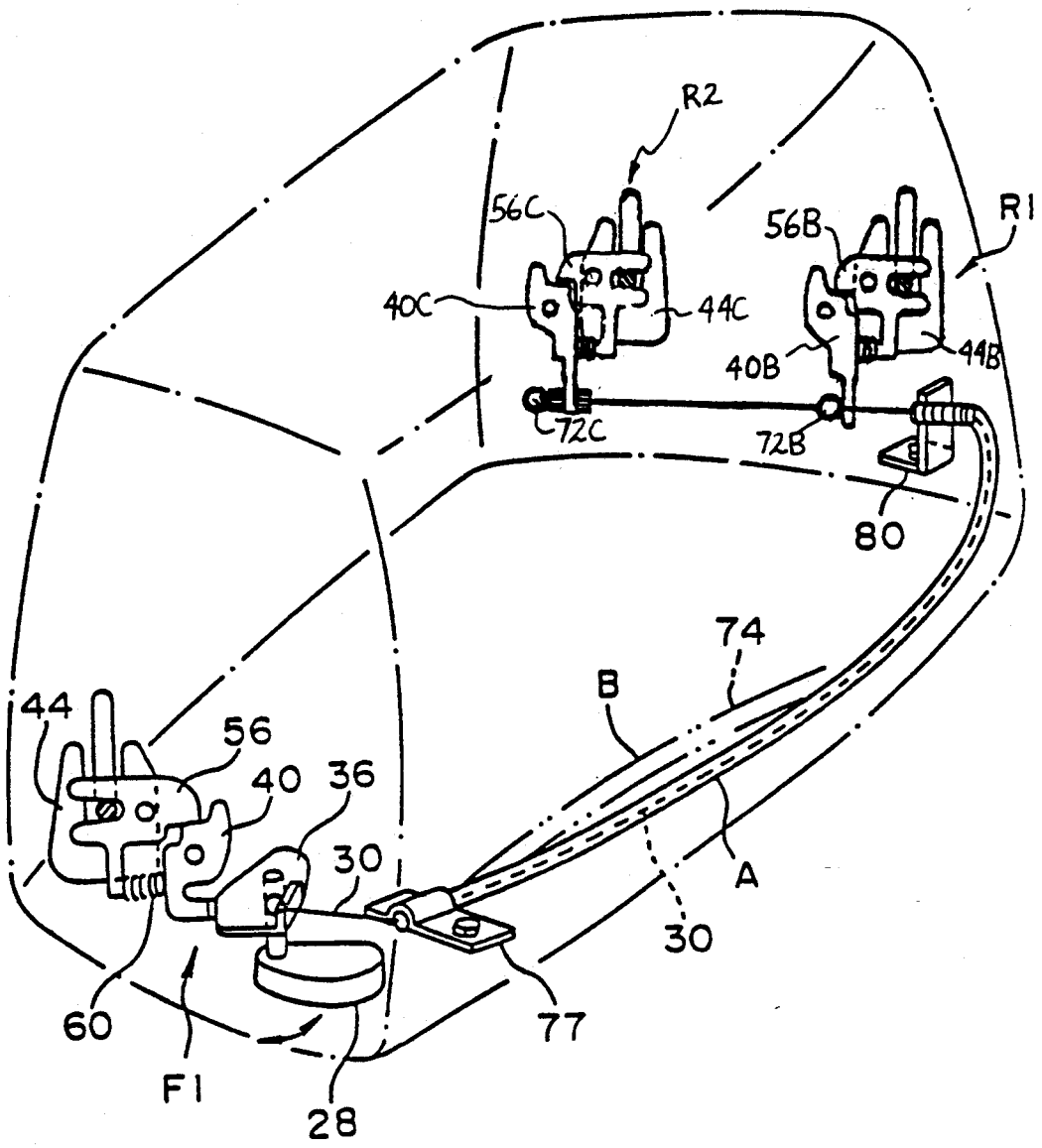
FIG. 2 depicts a latch assembly according to a first embodiment of the invention within a cowling.

Reference will now be made to FIG. 2, which depicts a latch assembly according to a first embodiment of the invention within lower and upper cowlings 22, 24. As depicted, the latch assembly of the present invention includes a single forward latch mechanism F1 and two rear latch mechanisms R1, R2. Front latch mechanism F1 is linked to rear latch mechanisms R1 and R2 by means of a wire cable 30.

Figure 3:
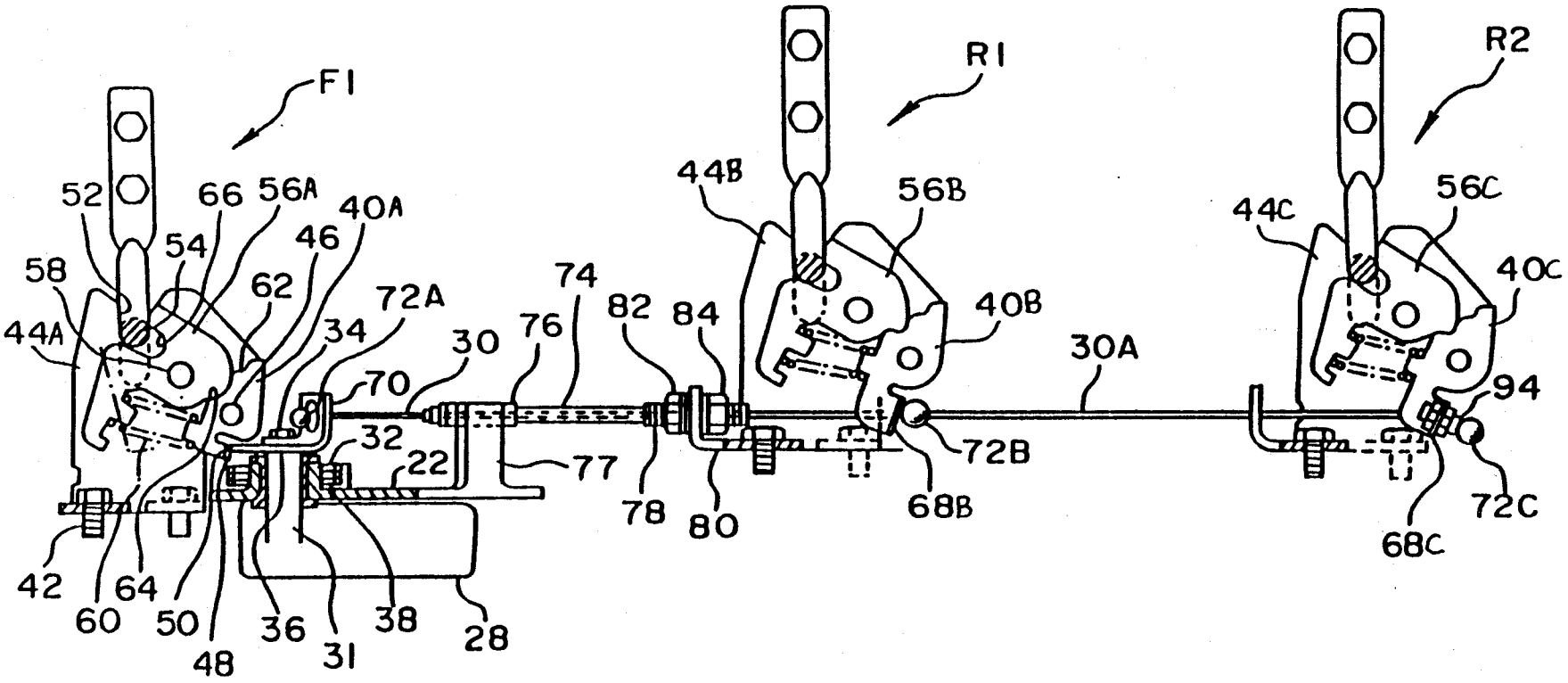
FIG. 3 shows a detailed layout of the latch assembly of the first embodiment.

With reference to both FIGS. 2 and 3, the specific structure of the latch assembly according to the first embodiment of the invention will now be described in detail wherein FIG. 2 depicts the latch assembly in an engaged or latched condition and FIG. 3 depicts the latch assembly in a disengaged condition. Clamping lever 28 is integrally formed with a rotatable shaft 31 which passes vertically through lower cowling 22. Shaft 31 is free to rotate with respect to lower cowling 22 via bearings 32. At the upper edge of shaft 31, there is a cam plate 36 attached thereto by means of a bolt 34. By this arrangement, cam plate 36 rotates as a unit with clamping lever 28. A coil spring 38 is positioned to bias clamping lever 28 towards its latched position, after clamping lever 28 has been rotated.

A bottom edge (not labelled) of cam plate 36 contacts a swinging lever 40A. Swinging lever 40A is free to pivot about a substantially horizontally extending pin 46 secured to a fixed plate 44A on lower cowling 22 by attachment bolts 42. A cam engagement member 48 is positioned on the bottom edge of swinging lever 40A. Cam engaging member 48 is in contact with a cam surface 50 of cam plate 36 such that rotation of clamping lever 28 causes pivoting of swing lever 40A through cam plate 36. Fixed plate 44A is provided with a retaining groove 52 which opens upward as viewed in FIG. 3. A horizontally projecting portion of a substantially L-shaped hook 54, which is fixedly secured to upper cowling 24 by bolts (not labelled), extends into this retaining groove 52 when upper cowling 24 is placed upon lower cowling 22. Groove 52 restrains movement of hook 54 in the lateral direction as shown.

A fork-plate 56A is rotatably mounted by means of a substantially horizontally extending pin 58 to fixed plate 44A. Fork-plate 56A is biased in a clockwise direction by means of a spring 60 positioned between fork-plate 56A and swing lever 40. Fork-plate 56A can rest upon two engagement surfaces of swing lever 40A, namely, a first engagement surface 62 and a second engagement surface 64 positioned forward of first engagement surface 62. When the rotating fork-plate 56A rests upon the first engagement surface 62 of swing lever 40A (see FIG. 2), the end of hook 54, positioned in the above-mentioned retaining groove 52 is held within a holding groove 66 of fork-plate 56A to further restrain hook 54 against vertical movements. When fork-plate 56 rests upon the second engagement surface 64, holding groove 66 has been repositioned so that hook 54 can be raised (see FIG. 3) and the upper cowling 24 can be removed from the lower cowling 22.

The first and second rear latch mechanisms R1 and R2 are constructed in a manner similar to front latch mechanism F1 described above. Corresponding parts between these latch mechanisms have been labelled accordingly in the drawings and therefore the description of these elements will not be repeated herein. The operation of clamping lever 28 is transmitted to the rear latch mechanisms R1 and R2 on the rear side of lower cowling 22 by means of a wire cable 30 extending between cam plate 36 and engagement member 68B and 68C formed as part of swinging levers 40B and 40C of rear latch mechanisms R1 and R2. More specifically, a wire-cable holding post 70, rising from one end of cam plate 36 of front latch mechanism F1, engages a stop member 72A which is secured to one end of wire cable 30. Additional stop members 72B and 72C are provided midway and at the end of wire cable 30, respectively. Stops 72B and 72C abut engagement members 68B and 68C, respectively. As a result, when the clamping lever 28 is rotated, cam plate 36 of front latch mechanism F1 also rotates and this rotational movement is transmitted through wire cable 30, which causes stop members 72B and 72C to be moved leftward, as depicted in FIG. 3, and swing levers 40B and 40C of rear latch mechanisms R1 and R2 to rotate clockwise. As shown in FIG. 3, the above mentioned wire cable 30 passes through a hollow tube 74 between front latch mechanism F1 and first rear latch mechanism R1. The front end of tube 74 is held by a bracket 77, which projects from lower cowling 22 at a first point along cable 30. The rear end of tube 74 is supported relative to a second bracket 80 located a fixed distance from bracket 77 by a threaded cylinder 78 so that it cannot be pulled out of cylinder 78. Cylinder 78 is attached to lower cowling 22 by the bracket 80. More specifically, cylinder 78 is attached and held in place by nuts 82 and 84 which are threaded on either side of bracket 80. With this construction, the threaded cylinder 78 can be moved toward or away from latch mechanism F1 by loosening one and tightening the other nut or by turning threaded cylinder 78 directly. In order to minimize or prevent twisting of tube 74 when turning cylinder 78 directly, some slippage between threaded cylinder 78 and tube 74 may be permitted. Accordingly, since the opposite end of the tube 74 cannot move axially when cylinder 78 is moved toward or away from first latch mechanism F1, movement of the tube 78 towards the latch mechanism causes the tube 74 to deflect laterally thereby effectively taking up slack in the cable 30 extending through the tube. Movement of the cylinder 78 in the opposite direction, of course, straightens the tube 74 and shortens the length traversed by the cable 30 between the bracket 77 and the tube 78. Thus, deflection of tube 74 to a greater or lesser extent varies the total length traversed by the cable 30 along the cable release system.

Figure 4:
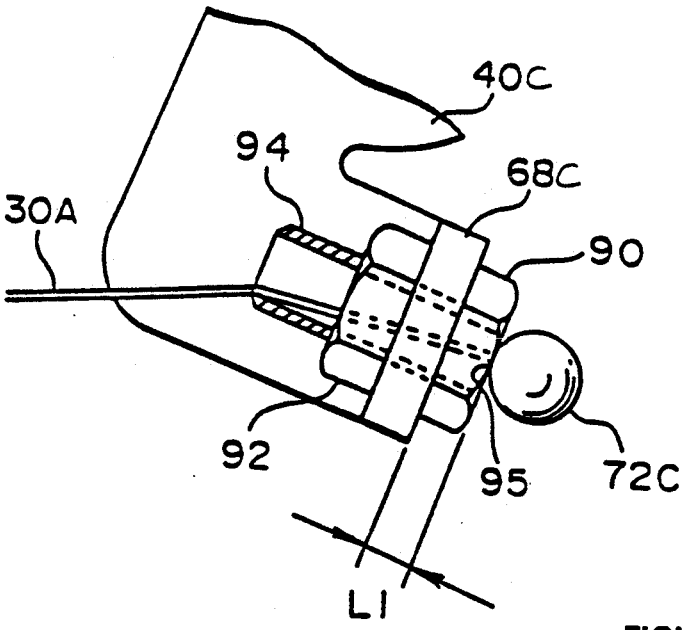
FIG. 4 is an enlarged view of an adjusting unit incorporated in the latch assembly of FIG. 3.

Note that there is no tube about wire cable 30 between the first rear latch mechanism R1 and the second rear latch mechanism R2. Instead, only the wire cable 30 extends between these latch mechanisms. As best shown in FIG. 4 of this embodiment, nuts 90 and 92 are located on both sides of engagement member 68C on the lower edge of the swing lever 40C on latch mechanism R2. Nuts 90 and 92 are threaded onto a hollow threaded cylinder 94 which passes through stop member 68C. Accordingly, in a manner similar to threaded cylinder 78 discussed above, the position of threaded cylinder 94 can be adjusted using nuts 90 and 92. Wire cable 30A passes through threaded cylinder 94 and is secured to stop member 72C, which has a diameter larger than the inside diameter of cylinder 94, is attached to wire cable 30 and is in contact with the end 95 of threaded cylinder 94 through stop member 72C.

The operation of the latch assembly of the first embodiment will now be described. When clamping lever 28 is manually rotated with the latch mechanisms F1, R1 and R2 in their latched state, cam plate 36 rotates to cause swing lever 40A to rotate in a clockwise direction. When swing lever 40A rotates, spring 60 causes fork-plate 56A to rotate clockwise about pin 58 from the first engagement surface 62 toward the second engagement surface 64. This causes hook 54 to be releasable from retaining groove 52 of fixed plate 44A and from holding groove 66 of fork-plate 56A. Thus, the front latch mechanism F1 becomes disengaged.

When clamping lever 28 is manually rotated to rotate cam plate 36, the wire cable 30 is pulled leftward as represented in FIG. 3. When this occurs, stop members 72B and 72C on the rear latch mechanisms R1 and R2 cause swing levers 40B and 40C to rotate in the clockwise direction. Accordingly, with the rotation of the clamping lever 28, all of the latch mechanisms F1, R1 and R2 are released from their latched conditions into disengaged states, allowing the upper cowling 24 to be removed from lower cowling 22.

If there is some slack in wire cable 30 between the front latch mechanism F1 and the rear latch mechanisms R1 and R2, there is a problem in that the rotation of clamping lever 28 will not be properly transmitted to the rear latch mechanisms R1 and R2. When this happens, as shown in FIG. 2, tube 74 will be in a position A prior to adjustment of the threaded cylinder 78. By adjusting cylinder 78, tube 74 moves to the position B shown by the double-dot broken lines thereby curving tube 74 further and increasing the amount of cable in the tube so as to take up the slack therein. Thus, when slack develops, it can be corrected.

Figure 5:
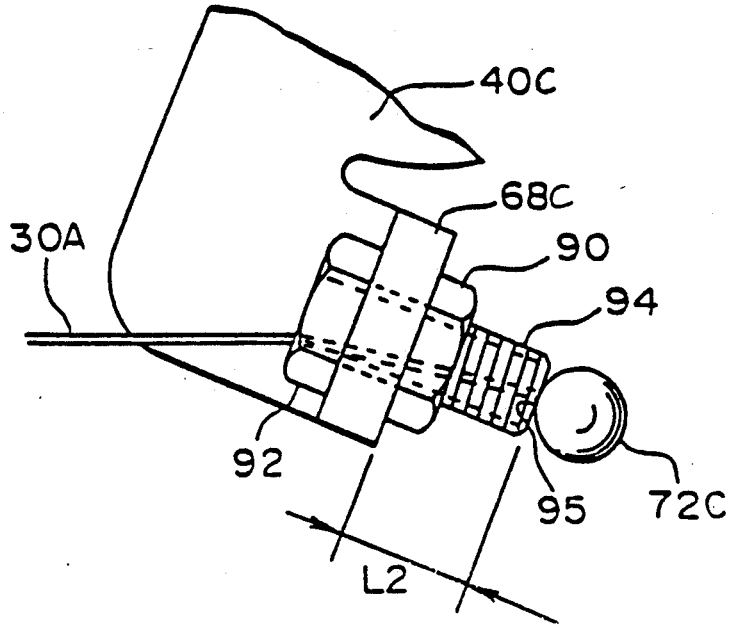
FIG. 5 depicts the adjusting unit of FIG. 4 in a second operating position.

The problem with slack in wire cable 30 can also develop in cable section 30A between the rear latch mechanisms R1 and R2. This problem is resolved by adjusting the position of the threaded cylinder 94 on latch mechanism R2 in order to take up the slack. FIG. 4 shows the wire cable 30 prior to adjusting the threaded cylinder 94 and FIG. 5 shows the state of threaded cylinder 94 after adjustment thereto so that it projects in the direction of the engagement member 68. Shifting of the threaded cylinder 94 causes it to project outward from the engagement member 68C thereby moving stop member 72C, engaged with the end of threaded cylinder 94, to the right in these figures. When this is done, the distance L2 (FIG. 5) between the engagement member 68C and the stop member 72C is greater than the distance L1 (FIG. 4) after the threaded cylinder 94 has been turned. This takes up the slack in the wire cable 30. Thus, with the structure of this embodiment, the disengaging action of the front latch mechanism F1 is fully transmitted to the rear latch mechanisms R1 and R2 so that upper cowling 24 can be reliably released from lower cowling 22. In this embodiment, the rear latching mechanisms R1 and R2 are spaced along the rear portion of the cowling in order to prevent the upper cowling 24 from rattling, to preclude gaps from developing between the upper cowling 24 and the lower cowling 22 so as to prevent water from entering, and to prevent any vibrations from developing between the upper and lower cowlings 24, 22 when the engine is running.

A second latch embodiment of the present invention will now be described with reference to FIG. 6. As the latch mechanism of the second embodiment contains substantially the same structure as that of the first embodiment described above, corresponding reference numerals have been carried over, and therefore the description of these elements and their operation will not be repeated here. In this embodiment, slack in wire cable 30A between the rear latch mechanisms R1 and R2 is relieved by means of the wire cable 30A passing through a tube 100. The ends of tube 100 are held in place by threaded cylinders 102 and 104, which are affixed to brackets 106A and 106B by means of nuts 108A, 108B and 110A, 110B threaded on the ends of cylinders 102 and 104 on either side of the brackets 106A and 106B, respectively.

Figure 6:
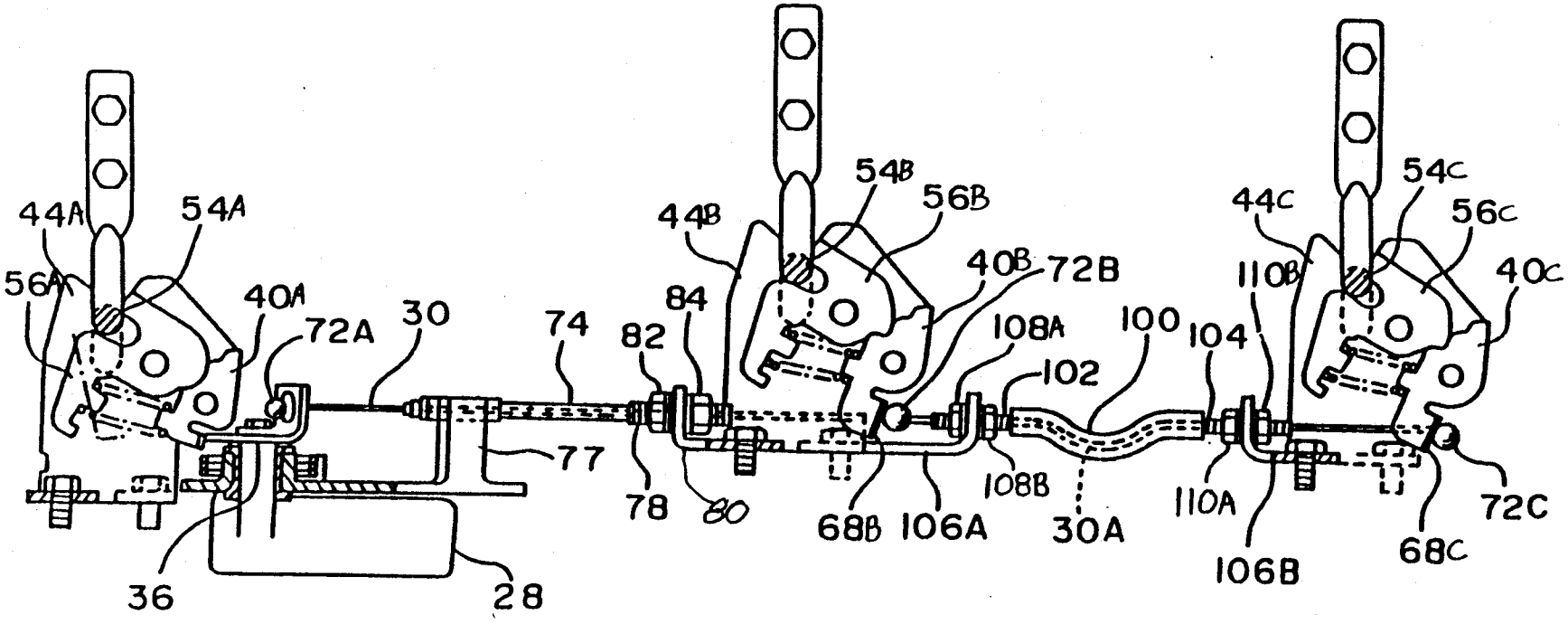
FIG. 6 depicts a latch assembly according to a second embodiment of the invention.

In this embodiment, any slack in wire cable 30A between the rear latch mechanisms R1 and R2 can be removed by adjusting at least one of the threaded cylinders 102, 104 in order to cause tube 100 between latch mechanisms R1 and R2 to curve as shown in FIG. 6 so as to take up the slack. If curving of tube 100 will cause it to interfere with other parts inside of the cowling or to be interfered with so that the slack in the wire cable 30A cannot be taken up, the adjustment mechanism of the first embodiment can be utilized. In either embodiment, if too much tension is applied to the wire cable 30 or 30A so that there is fear of it breaking, the curvature of tubes 74, 100 can be decreased or the threaded cylinders can be adjusted within their respective engagement members.

Although described with respect to preferred embodiments of the invention, it should be readily understood that various changes and/or modification can be made to the present invention without departing from the spirit or scope thereof. In general, the invention is only intended to be limited by the scope of the following claims.

I claim:

1. In a cowling for a marine propulsion engine wherein the cowling includes upper and lower separable sections secured by multiple latch mechanisms including a first latch mechanism directly actuated by an operating member and a second latch mechanism actuated by a flexible linkage connected to the operating member for simultaneous actuation with the first latch mechanism, and wherein said flexible linkage is susceptible to excess slack resulting in the failure of the second latch mechanism to fully respond to actuating movement of said operating member, the improvement comprising:

means for supporting the flexible linkage along its length at at least two points located a fixed distance apart, said supporting means permitting longitudinal movement of the flexible linkage between and beyond said two points, said means for supporting the flexible linkage comprising a tube enclosing the link of flexible linkage traversing said fixed distance;

means for adjusting the length of the flexible linkage required to traverse said fixed distance, said means for adjusting the length of flexible linkage traversing the fixed distance comprising means for deflecting the tube laterally of a straight line connecting the fixed points and permitting said longitudinal movement of said flexible linkage between and beyond said fixed points; and at least one means, separate from said length adjusting means, for directly removing slack from the flexible linkage by adjusting the length of the flexible linkage.

2. The improvement as claimed in claim 1, wherein the tube has a fixed total length defined between its ends and said means for deflecting the flexible tube comprises means for varying the linear distance between the tube ends.

3. The improvement as claimed in claim 2, wherein said means for varying the linear distance between the two ends of the flexible tube comprises at least one threaded element supporting one tube end relative to one of the fixed points, and cooperating threaded means for varying the position of said threaded element relative to its respective fixed point towards and away from the other fixed point, whereby rotating the cooperative threaded element moves said one tube end towards the other fixed point.

4. The improvement as claimed in claim 3, wherein said flexible linkage is a tension cable.

5. The improvement as claimed in claim 4, including a third latch mechanism actuated by said flexible linkage in series with said second latch mechanism.

6. The improvement as claimed in claim 5, wherein said means for removing slack from the flexible linkage acts between said second and third latch mechanisms.

7. The improvement as claimed in claim 6, wherein said means for removing slack comprises a second means for supporting the flexible linkage between a second pair points located a second fixed distance apart between said second and third latch mechanism, said second supporting means permitting longitudinal movement of the flexible linkage between and beyond said second pair of points; and second means for adjusting the length of flexible linkage required to traverse said second fixed distance, said second length adjusting means permitting axial movement of said flexible linkage between said fixed points.

8. The improvement as claimed in claim 7, wherein said means for supporting the flexible linkage comprises a second tube enclosing the length of flexible linkage traversing said second fixed distance, and said second means for adjusting the length of said flexible tube traversing said second distance comprising means for deflecting the tube laterally of a straight line connecting the second pair of fixed points.

9. The improvement as claimed in claim 8, wherein said second tube has a fixed total length defined between its ends and said second means for deflecting the second flexible tube comprises means for varying the linear distance between the ends of the second tube.

10. The improvement as claimed in claim 6, wherein said cowling includes at least front, rear and side walls, said means for supporting the flexible linkage being spaced along said side walls and said means for removing slack being located adjacent said rear wall.

* * * * *